US005318495A

United States Patent [19]

Malynowsky

[11] Patent Number: 5,318,495

[45] Date of Patent: Jun. 7, 1994

[54] METHOD FOR IMPROVING CIRCULATION BY OSCILLATION OF A RESILIENT FOOT REST

[76] Inventor: Harry Malynowsky, 4015 S. Woods Rd., Howell, Mich. 48843

[21] Appl. No.: 990,024

[22] Filed: Dec. 14, 1992

[51] Int. Cl.[5] ..... A63B 21/04

[52] U.S. Cl. ..... 482/129; 601/31; 482/907

[58] Field of Search ..... 482/121, 122, 126, 128, 482/129, 130, 143, 904, 77; 128/25 B, 48, 49, 51

[56] References Cited

U.S. PATENT DOCUMENTS

| | | | |
|---|---|---|---|
| 798,114 | 8/1905 | Rosenthal . | |
| 1,585,748 | 5/1926 | Wendelken | 482/129 |
| 2,183,265 | 12/1939 | Maloney . | |
| 2,274,574 | 2/1942 | Zerne . | |
| 2,919,134 | 12/1959 | Zuro . | |
| 3,510,128 | 5/1970 | Richardson . | |
| 3,606,321 | 9/1971 | Macoulis | 482/122 |
| 3,721,436 | 3/1973 | Barthel, Jr. | 482/69 |
| 3,724,450 | 4/1973 | Chaitin | 482/904 |
| 4,738,444 | 4/1988 | Linden | 482/128 |

FOREIGN PATENT DOCUMENTS 1075029 2/1960 Fed. Rep. of Germany ..... 482/129

OTHER PUBLICATIONS

Encyclopedia Britannica, vol. 11, p. 213 (1982).

*Primary Examiner*—Richard J. Apley
*Assistant Examiner*—Jeanne M. Mollo
*Attorney, Agent, or Firm*—Ian C. McLeod

[57] ABSTRACT

A method for using a device or activating the circulation of the lymphatic system in the legs of a user (100), is described. The device includes coil springs (26, 28) mounted on ends (16A, 16B) of cross shaft or arm (16) and supporting stirrups (30, 31) for the heel of the user in a sitting position. To activate the circulation of the lymphatic system, the heels of the user are first inserted into the supporting stirrups. Next, the user applies a downward force on the stirrups with the heels and finally, the user releases the downward force of the stirrups. The springs are constructed so that the legs of the user are moved in a vertically oscillating direction without significant exercise of the leg muscles and is particularly adapted for users who are unable to participate in normal activity due to age, illness or accident.

17 Claims, 2 Drawing Sheets

METHOD FOR IMPROVING CIRCULATION BY OSCILLATION OF A RESILIENT FOOT REST

BACKGROUND OF THE INVENTION (1) Field of the Invention

The present invention relates to a device for maintaining muscle activity and activating the lymphatic system particularly in a user not able to swim or walk due to illness, accident or age. In particular, the present invention relates to a device wherein a resilient means is connected to a support mechanism at one end and a stirrup at the other end. A user inserts a heel into the stirrup and in response to a brief downward force exerted by the heel in the stirrup, the resilient means oscillates up and down thereby maintaining muscle activity and activating the lymphatic system in the leg, without significantly exercising the muscles in the leg.

The lymphatic system is a system of vessels which closely parallels the blood vascular system. The lymphatic system helps maintain the proper fluid balance in the tissues and the blood by returning the blood protein and tissue fluid leaked from the blood vascular system to the blood. As a way to provide cells with nutrients, blood proteins seep out of the capillaries of the blood vascular system and into the interspacial spaces between the cells. Once the blood proteins diffuse from the capillaries of the blood vascular system into the tissue, the blood proteins are unable to be reabsorbed back into the circulatory system through the capillaries. The lymphatic system provides a method of removing the blood proteins from the spaces between the cells and transporting the blood proteins back into the circulatory system. The capillaries of the lymphatic system absorb the blood proteins from around the cells and into the lymphatic system. The blood proteins are removed through the vessels of the lymphatic system wherein the blood proteins are returned to the blood vascular system through the blood venous system. Unlike the blood vascular system which is controlled by the heart, the lymphatic system has no separate means to pump the lymph through the lymphatic system to the blood venous system. The lymph movement depends primarily on external forces such as muscular contraction, respiratory movement and gravity. Thus, to move the lymph, especially upward through the legs, the lymphatic system relys on a series of one way valves and compression of the valved lymphatic trunks by the surrounding leg muscles. Therefore, in order to keep the lymphatic fluid moving through the lymphatic system and thus remove blood proteins from around tissue cells, the muscles in a particular body area, such as the legs, must be kept active. New Encyclopedia Britannica, Vol. 11. p. 213, (1982).

By using the device of the present invention, the user is able to maintain a level of activity in the muscles of the legs for a longer period of time due to the low energy output required to operate the device. The longer the user's muscles are active, the longer the lymphatic system actively works to remove blood proteins from around the cells and through the lymphatic system. The longer the lymphatic system works actively to remove blood proteins the more nutrients which flow to the cells and the more waste which is removed from around the cells and consequently the healthier the cells.

(2) Prior Art

The prior art has described various types of exercising devices for appendages which use a resilient means attached to a stirrup or sling. The purpose of such devices is to exercise the muscles in the appendages. Illustrative of such devices are U.S. Pat. Nos. 798,114 to Rosenthal; 2,183,265 to Maloney; 2,274,574 to Zerne; 2,919,134 to Zuro; and 3,510,128 to Richardson.

Rosenthal describes an exercising device which is mounted onto a bed frame. The exercising device is comprised of elastic cords or helical springs which are attached at the upper end to the cross shaft which is attached to the bed and at the lower end to handles. The user is able to use the device either in the sitting or prone position depending on whether the arms or the legs are being exercised.

Maloney describes a bed service device which is attached to the ceiling or other support device over the bed. The device employs a system of ropes and pulleys to allow a user who is in the bed to use the ropes to position himself and also to use the slings or bars at the end of the ropes to exercise his limbs.

Zerne describes an exercising device which consists of a complicated system of rubber cords which form a set of loops and are attached at one end through a series of holes in an anchor plate to the ceiling. Depending on the particular user, certain loops are attached at the end opposite the anchor plate to slings which are intended to hold the user's arms or legs. The system is designed to be used by a person who is lying down for exercise of their arms or legs.

Zuro describes a home exercising device which consists of a main bar portion which is intended to be supported between two vertical supports such as a doorjamb. A pair of springs are attached at one end to the main bar portion and are provided with a handle at the opposite end. The main bar portion can also be held by the user while the legs of the user are positioned on the handles thus providing another form of exercise.

Richardson describes an exercising apparatus wherein the frame member is attached to a chair. The U-shaped frame extends between the arms of the chair in a generally vertical plane above the seat portion. The leg exerciser portion of the device consists of a pair of springs and stirrups. To use the device from the sitting position, the user places his feet in the stirrups and rotates his legs in a bicycle-like motion against the tension of the springs.

All the above devices are intended to be used to exercise the user's arms or legs particularly those of older people. There remains a need for a device which easily provides stimulation to the lymphatic system of the legs while not requiring the user to exercise and expend large amounts of energy.

OBJECTS

It is therefore an object of the present invention to provide a device which enables a user to provide stimulation to the lymphatic system of their legs, particularly persons who are not able to move their legs in the way which normally stimulates the lymphatic system. Further, it is an object of the present invention to provide a device which requires minimal effort to operate and yet provides the movement required to stimulate lymphatic circulation. Still further, it is an object of the present invention to provide a device which is easy to use and portable.

DETAILED DESCRIPTION OF THE PREFERRED EMBODIMENTS

Figure 1:
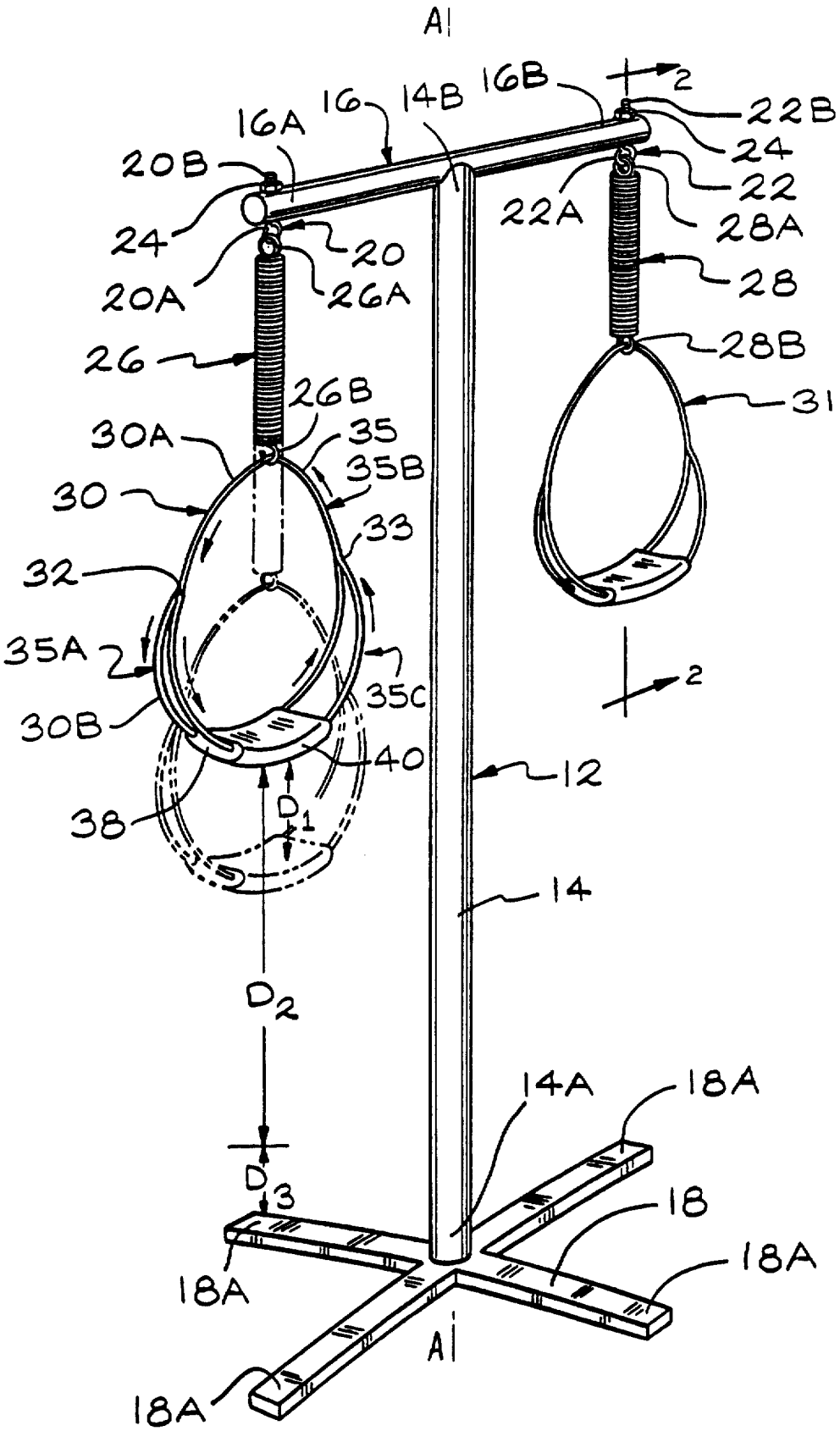
FIG. 1 is a perspective view of the lymphatic system activation device 10 showing a T-shaped support 12, the first coil spring 26 in the original and extended position and the second coil spring 28 in the original position only.

The present invention relates to a lymphatic system activation device which comprises: a support means having a main shaft defining an axis and arms extending from the axis; a pair of resilient means having a top end and a bottom end extending parallel to the axis with the top end connected to the arms support means; and a pair of stirrup means having an upper portion and a lower portion with the upper portion connected to the bottom end of each of the pair of resilient means, wherein the stirrup means and resilient means are mounted on the arms at a distance from the main shaft such that the heels of a user in a sitting position can fit into the stirrups and wherein the resilient means allows an oscillatory movement of the legs of the user to stimulate the circulation of the user without significant exercise of the muscles in the legs.

Furthermore, the present invention relates to a lymphatic system activation device which comprises: a T-shaped support means having a main shaft defining an axis, with a proximal end and a distal end, a cross shaft mounted at the proximal end of the main shaft perpendicular to the axis having a first end and a second end extending equal distance from the main shaft with a first aperture and a second aperture in the plane parallel to the axis in the first end and the second end spaced equal distance from the main shaft and a base means mounted at the distal end of the main shaft for stabilizing the T-shaped support means; a pair of mounting means, one mounted through each of the first and second apertures in the cross shaft extending downward parallel to the axis; a pair of resilient means having a top end and a bottom end with the top end connected to each of the pair of mounting means and extending downward toward the base means parallel to the axis; and a pair of stirrup means having an upper portion and a lower portion with the upper portion connected to the bottom end of each of the pair of resilient means, wherein the stirrup means and resilient means are mounted on the cross shaft at a distance from the main shaft such that the heels of a user in a sitting position can fit into the stirrups and wherein the resilient means allows an oscillatory movement of the legs of the user to stimulate the circulation of the user without significant exercise of the muscles of the legs.

The present invention also relates to a method for activating lymphatic circulation of an appendage of a user unable to maintain normal activity, which comprises: providing a support means having a main shaft defining an axis and arms extending from the axis; a pair of resilient means having a top end and a bottom end extending parallel to the axis with the top end connected to the arms support means; and a pair of stirrup means having an upper portion and a lower portion with the upper portion connected to the bottom end of each of the pair of resilient means, wherein the stirrup means and resilient means are mounted on the arms at a distance from the main shaft such that the heels of a user can fit into the stirrups and wherein the resilient means allows an oscillatory movement of the legs of the user to stimulate the circulation of the user without significant exercise of the appendage; inserting heels of the user in a sitting position in the stirrup means and resting the legs of the user adjacent the lower portion of the stirrup means; using the legs to apply a downward force on the stirrup means at the heels; releasing the downward force on the stirrup means and allowing the resilient means to pull the stirrup means and the legs upward toward an original position of the resilient means; and allowing the stirrup means and the legs to oscillate parallel to the axis in reaction to the resilience means.

The device of the present invention is portable and is used in front of a television set or the like while sitting in a chair. The user is provided with relief from poor lymphatic circulation in the legs.

Figure 2:
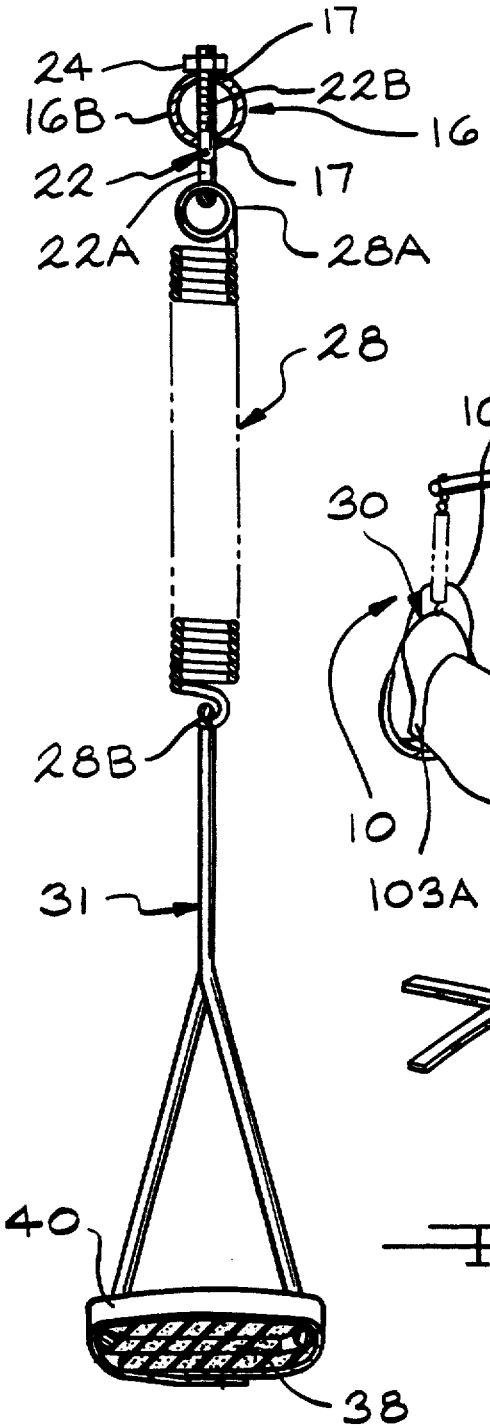
FIG. 2 is a cross-sectional view of FIG. 1 through line 2—2 showing the second coil spring 28 mounted to the second end 16B of the cross shaft 16 and the padding 38 and cover 40 of the second stirrup 31.

FIGS. 1 and 2 show the preferred embodiment of the lymphatic system activation device 10 of the present invention. As shown particularly in FIG. 1, the lymphatic system activation device 10 is comprised of a T-shaped support 12, a pair of coil springs 26 and 28 and a pair of stirrups 30 and 31.

The T-shaped support 12 is formed from a main shaft 14 with a distal end 14A and a proximal end 14B, extending along the axis A—A, an arm or cross shaft 16 mounted at the proximal end 14B of the main shaft 14 perpendicular to the axis A—A and a base 18 mounted at the distal end 14A of the main shaft 14. The cross shaft 16 has a first end 16A and a second end 16B extending equal and opposite distance from the main shaft 14. The first end 16A and the second end 16B are provided with a first aperture (not shown) and a second aperture 17 in a plane parallel to the axis A—A spaced equal distances from the main shaft 14. In the preferred embodiment, both the main shaft 14 and the cross shaft 16 (FIG. 2) have a circular cross section and are hollow. It is also preferred that the T-shaped support 12 be constructed of metal which is durable such as steel.

As shown in FIG. 1, the base 18 is formed by four legs 18A of equal length spaced 90° apart around the main shaft 14. The length of the legs 18A is proportional to the height of the main shaft 14 and the distance from the main shaft 14 of the first and second aperture 17 in the first and second end 16A and 16B of the cross shaft 16. The farther the apertures 17 are from the main shaft 14, the longer the legs 18A of the base 18 must be in order to provide adequate stability. The four legs 18A extend outward from the main shaft 14 in a plane angled slightly downward from the plane perpendicular to the axis A—A (FIG. 1). The angling of the legs 18A provides additional stability to the T-shaped support 12 without increasing the length of the legs 18A. For greater stability, the legs 18A should be longer than the ends 16A and 16B.

Mounted through each of the two apertures 17 of the cross shaft 16 is a first hook bolt 20 having a first hook portion 20A and a first bolt portion 20B and a second hook bolt 22 having a second hook portion 22A and a second bolt portion 22B. The hook bolts 20 and 22 are mounted such that the hook portions 20A and 22A extend downward parallel to the main shaft 14 toward the distal end 14A of the main shaft 14 and the bolt portions 20B and 22B extend upward through the apertures 17 (FIG. 2). The hook bolts 20 and 22 are held in place by nuts 24 mounted onto the bolt portions 20B and 22B of the hook bolts 20 and 22 adjacent the top of the cross shaft 16.

Mounted through each of the hook portions 20A and 22A of the first and second hook bolts 20 and 22 is a first coil spring 26 and a second coil spring 28. The first and second coil springs 26 and 28 each have a top end 26A and 28A and a bottom end 26B and 28B. In the preferred embodiment, the top end 26A and 28A is formed by a double circular loop while the bottom end 26B and 28B is a single loop with a small slit opening. The top end 26A and 28A of each coil spring 26 and 28 is mounted through one of the hook portions 20A and 22A of the first and second hook bolts 20 and 22 and extends downward from the first and second hook bolts 20 and 22 toward the base 18 of the T-shaped support 12 parallel to the axis A—A. Although a coil spring 26 and 28 is preferred, any other suitable elastic material can be used.

A first stirrup 30 and a second stirrup 31 is mounted at the bottom end 26B and 28B of each of the first and second coil springs 26 and 28. The first and second stirrups 30 and 31 are identical, therefore only the first stirrup 30 is described in detail. The first stirrup 30 has an upper portion 30A and a lower portion 30B which connect at a first intersection 32 and a second intersection 33. As shown in FIG. 1, the first stirrup 30 is formed by a single metal wire 35. One end of the wire 35 is located at the first intersection 32 of the upper portion 30A and the lower portion 30B and the other end of the wire 35 is located on the other side of the stirrup 30 at the second intersection 33. The formation of the stirrup 30 is symmetrical, therefore it does not matter which end of the wire 35 is chosen as the starting point for tracing the path of the wire 35 to form the stirrup 30. FIG. 1 shows with arrows one possible configuration of the wire 35.

The wire 35 of the stirrup 30 extends downward from the first intersection 32 and over to the opposite second intersection 33 forming a first downward arc 35A between the first and second intersection 32 and 33. The first downward arc 35A forms one half of the lower portion 30B of the stirrup 30. Next, the wire 35 extends upward from the second intersection 33 through the bottom end 26B of the coil spring 26 to the opposite first intersection 32 forming an upward arc 35B between the first and second intersections 32 and 33. The upward arc 35B forms the upper portion 30A of the stirrup 30 and enables the stirrup 30 to be mounted onto the coil spring 26. The final portion of the wire 35 extends downward from the first intersection 32 to the opposite second intersection 33 forming a second downward arc 35C between the first and second intersections 32 and 33. The second downward arc 35C forms the second half of the lower portion 30B of the stirrup 30. The first and second downward arcs 35A and 35C of the lower portion 30B of the stirrup 30 are spaced apart at the lowest point and converge upward such that the ends of the first and second downward arcs 35A and 35C meet at the first and second intersections 32 and 33. The first and second downward arcs 35A and 35C of the lower portion 30B are spaced in order to provide a wider purchase for the user's heel 103A during use of the device 10. In the preferred embodiment, the lower portion 30B of the stirrup 30 is surrounded by padding 38 which is enclosed in a cover 40 (FIG. 2). The padding 38 and cover 40 are used to cushion a user's heel 103A to make use of the device more comfortable. In the preferred embodiment, the cover 40 is constructed of a vinyl material and the padding 38 consists of a sponge rubber sheet double wrapped around the spaced apart section of the lower portion 30B of the first stirrup 30 (FIG. 2). Although the above mentioned padding 38 and cover 40 are preferred, any other variety of size or type of cover 40 or padding 38 could be used.

IN USE

Figure 3:
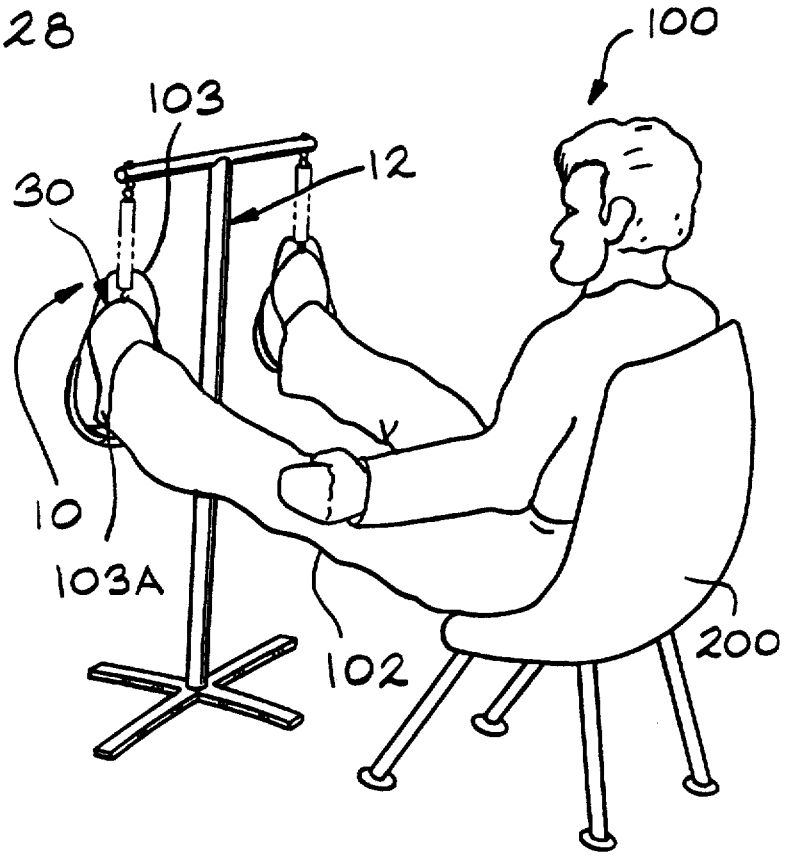
FIG. 3 is a perspective view of the lymphatic system activation device 10 with a user 100 positioned in a chair 200.

The lymphatic system stimulation device 10 of the present invention is intended to be used by a person 100 who is preferably in the sitting position to activate the lymphatic system (FIG. 3). The user 100 sits in a chair 200 and positions the device 10 directly in front of him. The lymphatic system stimulation device 10 should be spaced away from the chair 200 with the cross shaft 16 of the T-shaped support 12 positioned from left to right with respect to the user 100. The distance of the device 10 from the chair 200 is determined by the length of the user's legs 102. Once the user 100 is comfortably positioned in the chair 200, the device 10 should be spaced away from the user 100 such that when correctly inserted only the heel 103A of the foot 103 rests comfortably on the cover 40 of the stirrups 30 and 31 (FIG. 3). By inserting only the heel 103A into the stirrups 30 and 31, the user 100 can exert less force to operate the device 10. Thus, the user 100 achieves the maximum benefit with the least amount of effort.

Once the user 100 is in position with his heels 103A resting in the stirrups 30 and 31, the user 100 exerts a momentary downward force on each of the stirrups 30 and 31 causing the coil springs 26 and 28 to become stretched. The coil springs 26 and 28 will then react by contracting and pulling the user's legs 102 upward. The coil springs 26 and 28 will momentarily continue to oscillate up and down parallel to the axis A—A until all the energy in the coil springs 26 and 28, caused by the initial downward force, has been spent at which time the coil springs 26 and 28 will settle into their original extended position. Due to the necessary weakness of the coil springs 26 and 28, any resulting oscillation will be minimal. Once the coil springs 26 and 28 stop oscillating, the user 100 can exert another downward force to begin the oscillation once again. For prolonged activation of the lymphatic system, the user 100 applies and releases the downward force on the stirrups 30 and 31 continuously using first one leg and then the other. For example, once the coil springs 26 and 28 have contracted to their fullest extent such as when the oscillation cycle begins its downward motion, the user 100 will apply another downward force to once again energize the coil springs 26 and 28. In order for a user 100 to easily cause the coil springs 26 and 28 to oscillate, the resilience of the coil springs 26 and 28 and the height of the main shaft 14 is proportional to the user's strength and the user's weight.

The height of the main shaft 14 and the length and resilience of each coil spring 26 and 28 are interdependent and correspond to the particular size and strength of the user 100. The coil springs 26 and 28 are chosen such that upon insertion of a heel 103A into each stirrup 30 and 32, the weight of the leg 102 will cause each of the coil springs 26 and 28 to expand. Once the user 100 has inserted a heel 103A into each stirrup 30 and 31 and each coil spring 26 and 28 has come to rest at a new lower expanded position, the height of each stirrup 30 and 31 is such that the user 100 is comfortable in that position and the device 10 is being used as a foot rest. This height is achieved by either varying the height of the main shaft 14 of the T-shaped support 12 or by varying the resilience and length of the coil springs 26 and 28 or both. The user 100 is able to sit comfortably with his heels 103A in the stirrups 30 and 31 without moving. The coil springs 26 and 28 and the T-shaped support 12 are preferably chosen such that upon resting the heels 103A in the stirrups 30 and 31, the coil springs 26 and 28 do not expand such that the stirrups 30 and 31 touch the floor. As shown in FIG. 1, the resilience of the coil springs 26 and 28 allows the coil springs 26 and 28 to be stretched downward a total at rest distance of D1 which is preferably about 10 cm upon insertion of the heels 103A of the foot 103 into the stirrups 30 and 31 without applying any downward force.

The device 10 is also constructed such that the user 100 cannot easily extend the coil springs 26 and 28 so as to touch the base 18 of the T-shaped support 12 and such that during oscillation, the stirrups 30 and 31 do not touch either the base 18 or the cross shaft 16 of the T-shaped support 12. The coil springs 26 and 28 have a resilience such that the weight of the user's legs 102 extends the coil springs 26 and 28 downward and conversely pulls the user's legs 102 upward when the user 100 releases the applied downward force on the coil springs 26 and 28. As shown in FIG. 1, the resilience of the coil springs 26 and 28 allows the stirrups 30 and 31 to move parallel to the axis A—A a total top to bottom distance D2 which is about 40 to 60 cm, preferably about 54 cm or such that the heels 103A, in place in the stirrups 30 and 31, are within a distance D3 of preferably about 5 to 10 cm, of the floor at maximum oscillation. For an average person 5'7" and 160 lbs, with average strength, the height of the main shaft 14 should be at least about 107 cm and the spring should have a length of at least 22 cm with a resiliency of about 20 lbs/inch. On the average, the resilience of the coil springs 26 and 28 should preferably be about 5 to 40 lbs/inch with a resilience in the range of 5 to 10 lbs/inch for children, 10 to 20 lbs/inch for average adults and 25 to 30 lbs/inch for heavier adults. The device can be adjusted to accommodate users 100 of various sizes by telescoping the end 16 of shaft 14. These variations and other variations will be obvious to those skilled in the art.

The minimal force needed to energize the coil springs 26 and 28 and the resilience of the coil springs 26 and 28 allows for a continuous up and down motion of the legs 102 without the user 100 expending a large amount of energy. The up and down movement of the legs 102 maintains the activity level in the legs 102 which in turn activates the lymphatic system such that lymph is absorbed away from the cells in the legs 102 and moved up the lymphatic vessels and ultimately into the subclavian vein wherein the lymph is returned to the circulatory system. By keeping the lymph flowing around and away from the cells, the cells remain healthy and the level of lymph in the spaces between the cells remains normal thus preventing soreness or swelling in the user's legs 102. The device of the present invention has been found to provide relief from poor lymphatic circulation, particularly in the legs 102.

It is intended that the foregoing description be only illustrative of the present invention and that the invention be limited only by the hereinafter appended claims.

I claim:

1. A method for activating lymphatic circulation of an appendage of a user unable to maintain normal activity, which comprises:

(a) providing a lymphatic system activation device with a support means having a main shaft defining an axis and stationary arms extending from the axis; a pair of resilient means having a top end and a bottom end extending parallel to the axis with the top end connected to the arms of the support means; and a pair of stirrup means having an upper portion and a lower portion with the upper portion connected to the bottom end of each of the pair of resilient means, wherein the stirrup means and resilient means are mounted on the arms at a distance from the main shaft wherein the distance between the upper portion and the lower portion is such that a foot of a user can fit into each stirrup means with a heel of the foot adjacent the lower portion of the stirrup means and wherein the resilience of the resilient means allows an oscillatory movement of a leg of the user in the stirrup means in response to the removal of an initial downward force applied to the stirrup means by the heels of the user to stimulate the circulation of the user without significant exercise of the appendage;

(b) inserting heels of the user in a sitting position in the stirrup means and resting the legs of the user adjacent the lower portion of the stirrup means;

(c) using the legs to apply a downward force on the stirrup means at the heels;

(d) releasing the downward force on the stirrup means and allowing the resilient means to pull the stirrup means and the legs upward toward an original position of the resilient means; and (e) allowing the stirrup means and the legs to oscillate parallel to the axis in reaction to the resilient means.

2. The method of claim 1 wherein the step of providing the lymphatic system activation device includes using a coil spring as the resilient means.

3. The method of claim 2 wherein the step of providing the lymphatic system activation device includes varying the resilience of the coil spring to accommodate a specific user.

4. The method of claim 2 wherein the resilience of the coil spring is such as to become stretched when a slight downward force is applied.

5. The method of claim 1 wherein the step of providing the lymphatic system activation device includes using a hook bolt as the mounting means.

6. The method of claim 1 wherein the step of providing the lymphatic system activation device includes having the lower portion of the stirrup means wider than the upper portion to provide a resting place for the heel of the user upon inserting the heel into the stirrup.

7. The method of claim 6 wherein the step of providing the lymphatic system activation device includes providing the wider lower portion of the stirrup means with a padded covering to cushion the heel of the user upon inserting the heel into the stirrup.

8. The method of claim 1 wherein the step of providing the lymphatic system activation device includes providing the support means with a base means wherein the base means includes four legs spaced 90° apart extending outward from the main shaft and angled slightly downward from a plane perpendicular to the axis.

9. The method of claim 8 wherein the step of providing the lymphatic system activation device includes providing each of the four legs with a length longer than a length of the arms of the support means such as to provide stability for the main shaft.

10. The method of claim 1 wherein the resilience of the resilient means is such that the resilient means extends about 10 cm with the heel of the user at rest in the stirrups and without the downward force being applied by the user.

11. The method of claim 1 wherein the stirrup means moves parallel to the axis with a total top to bottom distance of about 40 to 60 cm.

12. The method of claim 1 wherein the stirrup means moves parallel to the axis to within about 5 to 10 cm of the floor at maximum oscillation.

13. The method of claim 1 wherein the resilient means has a resilience of about 20 lbs/inch when adapted for an average person 5'7" and 160 lbs with average strength.

14. The method of claim 1 wherein the resilient means has an average resilience range between about 5 and 40 lbs/inch.

15. The method of claim 1 wherein the resilient means has a resilience between about 5 to 10 lbs/inch when adapted for an average child.

16. The method of claim 1 wherein the resilient means has a resilience of about 10 to 20 lbs/inch when adapted for an average adult.

17. The method of claim 1 wherein the resilient means has a resilience of about 25 to 30 lbs/inch when adapted for an adult who is heavier than an average adult.

* * * * *